United States Patent [19]

Tryon

[11] 3,972,554

[45] Aug. 3, 1976

[54] RING TYPE RECOVERY TOOL

[75] Inventor: Paul V. Tryon, Kailua, Hawaii

[73] Assignee: The United States of America as represented by the Secretary of the Navy, Washington, D.C.

[22] Filed: Jan. 12, 1976

[21] Appl. No.: 648,353

[52] U.S. Cl. ..... 294/97; 294/66 R

[51] Int. Cl.[2] ..... B63C 7/16; B66C 1/54

[58] Field of Search ..... 294/86 R, 86.24, 89, 294/93, 95, 97, 66 R, 100, 110 R, 115; 85/3 R, 3 S; 114/50, 51

[56] References Cited

UNITED STATES PATENTS

| | | | |
|---|---|---|---|
| 886,194 | 4/1908 | Downer et al. | 294/97 X |
| 2,507,577 | 5/1950 | Reynolds | 294/93 |
| 3,132,890 | 5/1964 | Beaudet | 294/86 R |
| 3,307,871 | 3/1967 | Russell et al. | 294/86 R |
| 3,933,390 | 1/1976 | Barrett et al. | 294/97 X |

*Primary Examiner*—Johnny D. Cherry

*Attorney, Agent, or Firm*—Richard S. Sciascia; Ervin F. Johnston; Thomas Glenn Keough

[57] ABSTRACT

A recovery tool is located and affixed to a recovery object by a mechanical manipulator extending from an undersea vehicle. The manipulator squeezes a pair of spring biased actuators on the tool and interconnected linkage is displaced. The displaced linkage longitudinally slides an actuator tube on a lift rod and rotates a crossbar from its orthogonal disposition on the lift rod to an axially aligned position. The manipulator inserts the lift rod through a hole or ring provided in the recovery object and relaxes its squeezing force. The spring biased actuators spread apart and the interconnected linkage withdraws the actuator tube. A small spring carried inside the lift rod rotates the cross bar to its orthogonal position. When so disposed the crossbar cannot be withdrawn through the hole on the object. Thusly, a hoisting cable coupled to the recovery tool is joined to the object allowing its recovery to a surface or other undersea craft.

9 Claims, 7 Drawing Figures

RING TYPE RECOVERY TOOL

STATEMENT OF GOVERNMENT INTEREST

The invention described herein may be manufactured and used by or for the Government of the United States of America for governmental purposes without the payment of any royalties thereon or therefor.

BACKGROUND OF THE INVENTION

The new generation of submersibles often requires sophisticated tools to work effectively. One of the tasks frequently called for is the recovery of instrumentation or practice ordnance from the ocean floor. A number of the more advanced submersibles have articulable manipulators. These hand-like devices are controlled from inside the submersibles and are used to grasp objects of interest. In the past, the manipulators actually tied or wrapped recovery lines about objects or tried to attach some sort of a grapnel hook to them. Obviously, this attachment process often is quite involved and tedious. As the state of the art continued to advance a wide variety of clamps and tong-like devices for grasping an object have evolved. Those that were capable of supporting any appreciable amount of weight are unduly cumbersome and others relied on a relatively complicated actuation sequence calling for a number of hydraulic and electrical lines. Excessive weight and complicated actuators are luxuries which should be avoided by present day submersibles for ballast and trim usually are critical and too many hull penetraters can compromise the structural integrity of the craft. What is needed, therefore, is a compact recovery tool of sound mechanical design to assure high reliability and which has the capability of being positioned, removed and repositioned by the manipulator of an undersea craft. The recovery tool also should be of a design to allow interconnection to an object which has been provided with an opening specifically sized for engagement by the tool.

SUMMARY OF THE INVENTION

The present invention is directed to providing an apparatus for recovering objects provided with an opening. A pair of spaced apart side plates are each formed with at least one lateral slot and a pair of actuators are slidably mounted in the slots and adapted for reciprocal converging motion. The actuators are held apart by a pair of biasing springs and a lift rod is affixed to and projects from the side plates. Linkage extends from both the actuators to an actuator tube coaxially carried on te lift rod. Squeezing the two actuators together axially displaces the actuator tube to rotate a crossbar from its orthogonal disposition on the end of the lift rod to an in-line disposition. After the lift rod has been inserted through the opening in the object, relaxing the pressure on the actuators withdraws the actuator tube and the crossbar rotates to an orthogonal disposition on the end of the lift rod to prevent withdrawal through the opening.

It's an object of the invention to provide an improved recovery tool.

Another object is to provide a tool which is capable of being actuated by the manipulator of a submersible.

Yet another object is to provide a recovery tool configured to engage a ring or an opening on an object.

Still another object is to provide a recovery tool of high reliability due to its uncomplicated design.

Yet another object is to provide a recovery tool having a simple actuation sequence.

Still another object is to provide a recovery tool not necessitating additional hydraulic or electrical hull penetrators for its actuation.

These and other objects of the invention will become more readily apparent from the ensuing description when taken together with the drawings.

DESCRIPTION OF THE PREFERRED EMBODIMENT

Figure 1:
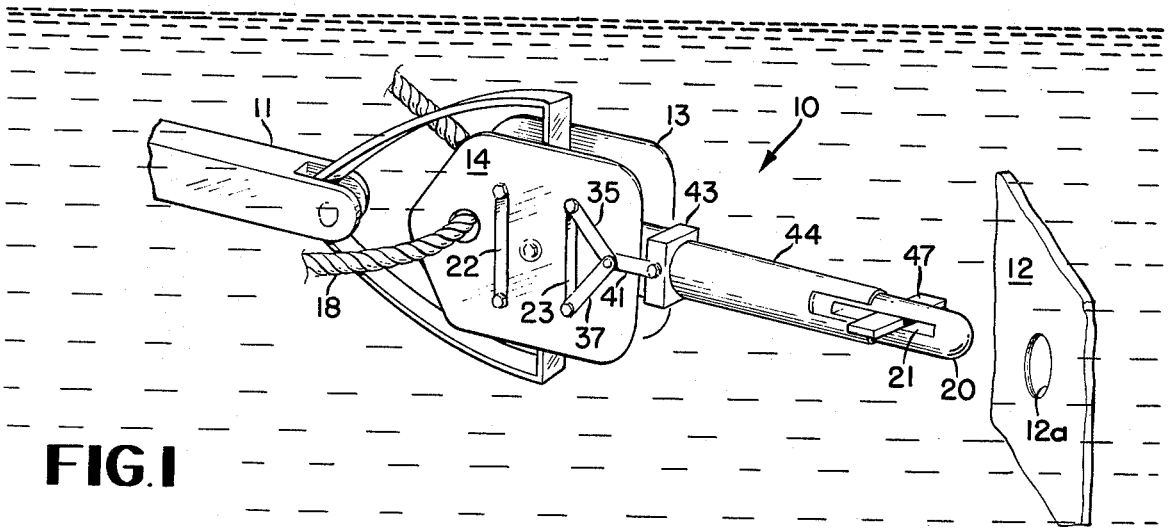
FIG. 1 is an isometric view of the tool held by a manipulator and approaching an object to be recovered.

Referring now to the drawings a recovery tool 10 is being carried by a manipulator 11 to the site where an object 12 to be recovered is located. The tool is held, positioned and actuated by the manipulator which extends from a submersible. Such manipulators are in use on some of the more sophisticated submersibles and rely upon hydraulic or electrical driving mechanisms to open and close them.

The object can be expended practice ordnance or an instrumentation package of interest to scientists. Whatever the case, to ensure a reliable mechanical connection with the recovery tool, the object is provided with a specifically diametered hole or ring 12*a*.

The recovery tool is constructed from elements which are corrosion resistent or noncorrosive to help ensure more reliable functioning in the harsh marine environment. Appropriate preventive maintenance, e.g. polishing, proper lubrication, etc., is followed which is consistent with proven marine design.

A pair of side plates 13 and 14 is held together by at least one bolt 15 and separated at a predetermined distance by a spacer 16 carried on the bolt. Other elements to be discussed later also cooperate to maintain the structural integrity of the recovery tool in addition to the bolt and spacer.

At one end of the side plates a pair of aligned holes 17 is provided to receive a hoisting cable 18. The holes are bored in the side plates along longitudinal center lines so that when the hoisting cable is passed through them and begins to raise a recovered object, the hoisting force is transmitted directly along the tool's center line. This force transmittal avoids the creation of bending moments which otherwise would necessitate the tool's being built more substantially with a consequent increase in weight.

Figure 5:
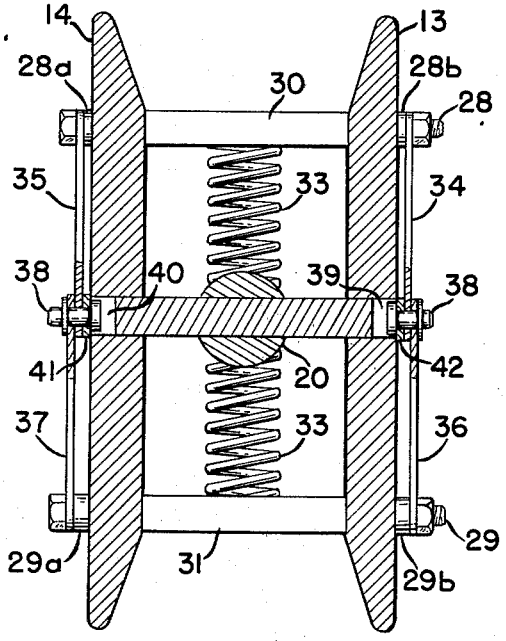
FIG. 5 is a cross sectional view taken along lines 5—5 in FIG. 4.

At the opposite end of the tool a rectangularly shaped structural member 19 is welded between side plates 13 and 14. Noting FIG. 5, greater strength was realized by welding the opposite ends of the structural member into a pair of cuts provided in the side plates. An axially extending lift rod 20 is welded onto the structural member and is provided with a milled-out rectangularly-shaped cavity 21. The lift rod is the part of the recovery tool which is inserted through the hole in the recovery object. It is located on the tool's center line to in-line transmit the lifting force via the side plates and hoisting cable.

The side plates are provided with a pair of lateral slots 22 and 23 in plate 14 and a pair of slots 24 and 25 in plate 13. The slots on each plate are arranged in a parallel relationship and each plate's slots are laterally aligned with respect to the other plate's slots. The slots are so arranged to receive appropriately sized follower bolts 26, 27, 28 and 29.

All the follower bolts extend through the slots and beyond the lateral dimensions of the side plates. Follower bolts 26 and 28 also reach through an actuator pad 30 while bolts 27 and 29 similarly extend through an actuator pad 31.

The pads are sized to slidably fit within the lateral spacing of the side plates to allow a reciprocal converging motion. The pads are fabricated from a semirigid material and, optionally, have roughened or serrated outwardly facing surfaces to aid the manipulator's gripping the tool. Helical biasing springs 32 and 33 are held between the pads and force them apart. The spring's constants are such as to require at least a moderate pressure by the manipulator to overcome their biasing effect.

Upper scissor links 34 and 35 are journaled on follower bolt 28 and lower scissor links 36 and 37 are journaled on follower bolt 29. Upper spacers **28*a* and 28*b* ensure that the upper scissor links are free for rotational motion near the outer surface of the side plates while lower spacers 29*a* and 29*b* keep the rotational plane of the lower scissors links slightly outside of the upper scissors links' rotational plane. Separation of the two rotational planes avoids any binding where the upper and lower scissors links are pivotally connected by link pins 38.**

The link pins extend into a pair of longitudinal grooves 39 and 40 which lie adjacent to the ends of welded structural member 19. The link pins also are journaled to a pair of connector links 41 and 42 each being bolted at their opposite ends to a linkage mounting 43. The linkage mounting laterally reaches across the width of the recovery tool and is welded onto an actuator tube 44.

The tube is sized to slidably fit around lift rod 20 and thereby is capable of reciprocable motion on the lift rod. A slot 45 is cut on one side of the actuator tube and diametrically opposed from the slot a bearing portion 46 is provided.

The rectangularly shaped cavity 21 houses a crossbar 47 journaled on an axial pin 48. The crossbar is capable of ninety degree rotational motion about the axial pin. The width of the crossbar is small enough to pass through hole **12*a* in the recovery object 12 but the crossbar's length is too long to be pulled through the hole when the crossbar is at right angles to lift rod 20. A biasing spring 49** urges the crossbar to orient itself in an orthogonally disposed relationship to the lift rod.

Recovery of an object is greatly simplified provided the object has a hole **12*a* or a ring with an inner diameter slightly larger than the outer diameter of actuator tube 44. The submersible approaches the object and its manipulator squeezes pads 30 and 31 together. Upper scissors links 34 and 35 and lower scissors links 36 and 37 transform the converging motion of the actuator pads into longitudinal force and motion. Connector links 41 and 42 couple this motion to actuator tube 44 via linkage mount 43.**

Figure 2:
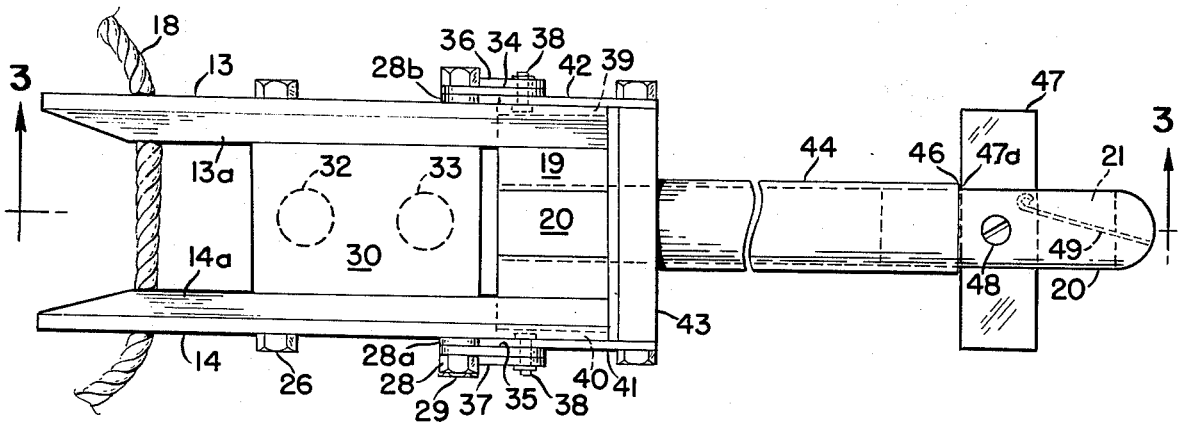
FIG. 2 is a top view of the recovery tool.
Figure 3:
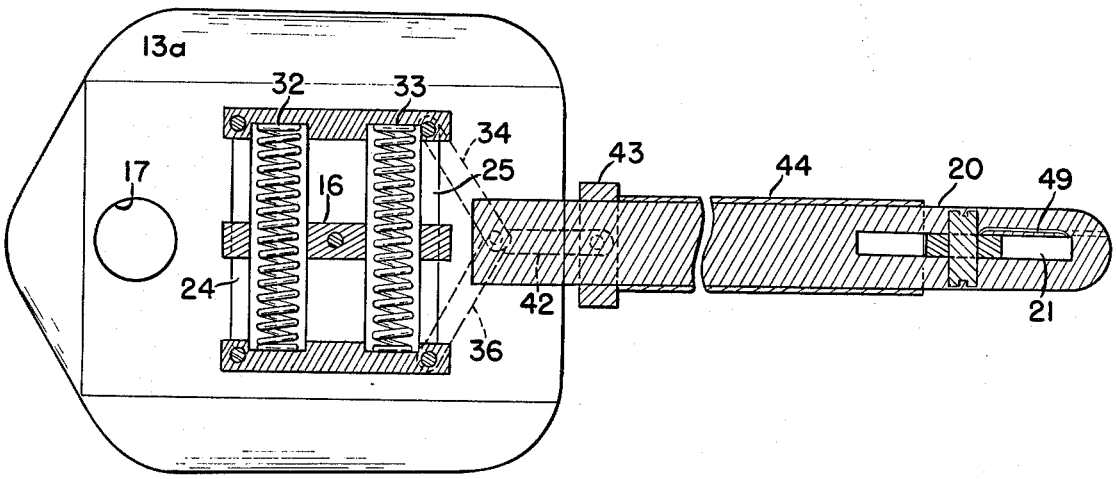
FIG. 3 is a cross-sectional view of the tool taken along lines 3—3 in FIG. 2.
Figure 4:
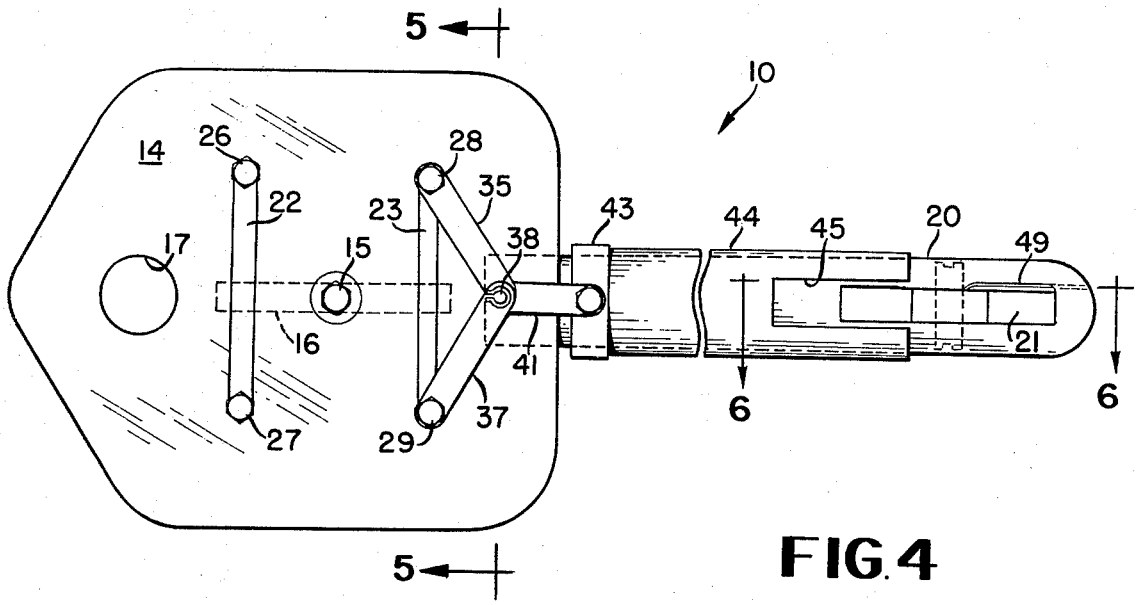
FIG. 4 is a side view of the recovery tool.
Figure 6A:
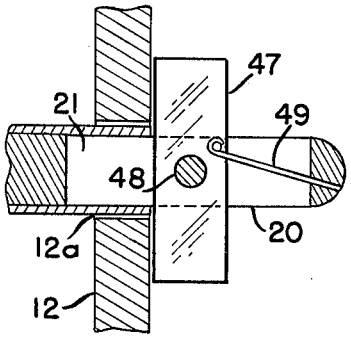
FIGS. 6*a* and 6*b* taken along 6—6 in FIG. 4 show the crossbar in the orthogonally disposed and inline positions.
Figure 6B:
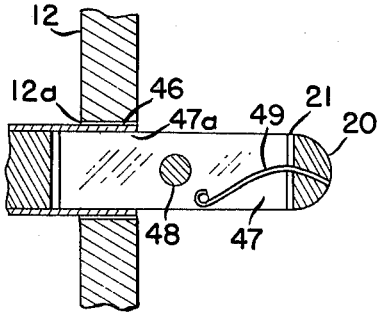

Bearing portion 46 bears against crossbar 47 on a surface **47*a* causing the crossbar to rotate about pin 48 in a clockwise motion, see FIGS. 2, 6*a*, and 6*b*. The biasing force of biasing spring 49 is overcome until the crossbar is rotated to a position completely within rectangularly shaped cavity 21, see FIG. 6*b*. Because the end of actuator tube 44 has been provided with slot 45 on one side, crossbar 47** is free to rotate completely within the cavity.

Manipulator 11 now inserts lift rod 20 and actuator tube 44 through hole **12*a*. This being done, the manipulator relaxes its gripping force on the recovery tool and biasing springs 32 and 33 retract the actuator tube via the scissors and connector linkage. Biasing spring 49 rotates crossbar 47 in a counter-clockwise direction to its normal perpendicular orientation with respect to the lift rod. Hoisting cable 18 begins to exert a lifting force and since crossbar 47 cannot be pulled through hole 12*a*** recovery is assured.

Should the operators of the submersible discover that the object the recovery tool has engaged is not the object they wanted to recover or that they want to engage the object at a different location, the manipulator need only reapply the squeezing force to the actuator pads to rotate and retract the crossbar within the rectangularly shaped cavity. After drawing the lift rod and actuator tube from the ring or hole, the tool can be recoupled as desired.

Obviously, many modifications and variations of the present invention are possible in the light of the above teachings, and, it is therefore understood that within the scope of the disclosed inventive concept, the invention may be practiced otherwise than specifically described.

What is claimed is:

1. An apparatus for recovering objects having an opening comprising:

a pair of spaced apart side plates each provided with at least one lateral slot;

means connected to the side plates for extending therefrom and having a diameter less than the opening and being provided with a cavity;

a pair of actuators each slidably mounted in the lateral slots of both side plates and adapted for reciprocable converging motion;

means carried between the actuators for holding them apart;

means coupled to the actuators for translating converging motion thereof into a longitudinal force;

means carried near the end of the extending means and coupled to receive the longitudinal force for rotating into the cavity upon the reception of the longitudinal force.

2. An apparatus according to claim 1 further including:

means coupled to the rotating means for biasing it to a position projecting radially outwardly from the diameter of the extending means.

3. An apparatus according to claim 2 further including:

means connected to the translating means and contacting the rotating means for slidably transmitting the longitudinal force thereto.

4. An apparatus according to claim 3 further including:

means located at the opposite end of the side plates from the extending means and centrally aligned therewith for lifting the object.

5. An apparatus according to claim 4 in which there are provided two parallel lateral slots in each side plate and the actuators are spring biased pads held in the slots by follower bolts.

6. An apparatus according to claim 5 in which the translating means is a scissors linkage coupled to the follower bolts.

7. An apparatus according to claim 6 in which the extending means is a lift rod, the lifting means is a pair of holes for receiving a hoisting cable and the holding means is a pair of helical biasing springs.

8. An apparatus according to claim 7 in which the rotating means is a crossbar journaled at its center in the cavity and the biasing means is a spring urging the crossbar to orthogonally extend from the lift rod.

9. An apparatus according to claim 8 in which the slidably transmitting means is an actuator tube provided with a bearing portion contacting the crossbar for effecting its rotation and further provided with a slot diametrically opposed from the bearing portion to permit the rotation.

* * * * *